US012345120B2

(12) United States Patent
Greci et al.

(10) Patent No.: US 12,345,120 B2
(45) Date of Patent: Jul. 1, 2025

(54) FAST-ACTING SWELLABLE DOWNHOLE SEAL

(71) Applicant: Halliburton Energy Services, Inc., Houston, TX (US)

(72) Inventors: Stephen Michael Greci, Little Elm, TX (US); Michael Linley Fripp, Singapore (SG); Brandon T. Least, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/741,039

(22) Filed: May 10, 2022

(65) Prior Publication Data

US 2023/0366289 A1 Nov. 16, 2023

(51) Int. Cl.
*E21B 33/128* (2006.01)
*E21B 33/12* (2006.01)

(52) U.S. Cl.
CPC ..... *E21B 33/128* (2013.01); *E21B 33/1208* (2013.01)

(58) Field of Classification Search
CPC ... E21B 17/1021–1028; E21B 33/1208; E21B 33/128
See application file for complete search history.

(56) References Cited

U.S. PATENT DOCUMENTS 2,830,540 A * 4/1958 Renic ..... E21B 33/128 277/340
7,841,417 B2 * 11/2010 Allison ..... E21B 33/1208 166/387
10,428,615 B2 * 10/2019 Saltel ..... E21B 33/127
11,047,203 B2 6/2021 Fripp et al.
11,299,955 B2 4/2022 Fripp et al.
(Continued)

FOREIGN PATENT DOCUMENTS

EP 3405647 B1 4/2022
WO 2019164499 8/2019

OTHER PUBLICATIONS

Candice Ellison,et al (2018) Dielectric characterization of bentonite clay at various moisture contents and with mixtures of biomass in the microwave spectrum, Journal of Microwave Power and Electromagnetic Energy, 52:1, 3-15, DOI: 10.1080/08327823.2017.1421407 (Year: 2018).*

(Continued)

*Primary Examiner* — Theodore N Yao
(74) *Attorney, Agent, or Firm* — Scott Richardson; C. Tumey Law Group PLLC

(57) ABSTRACT

A downhole sealing tool and method use a swellable material (e.g., a swellable rubber or a swellable metallic material) with increased surface area for faster reaction with an activation fluid. In one example, a swellable metallic sealing element and actuator are carried on a tool mandrel for lowering into a wellbore on a conveyance. The sealing element includes a plurality of expandable metal wires supported along the tool mandrel. The expandable metal wires comprise a swellable metallic material that swells in response to exposure to an activation fluid. The actuator is used to separate at least a portion of the expandable metal wires, to increase a surface area exposed to the activation fluid and thereby accelerate the reaction.

7 Claims, 5 Drawing Sheets

(56) References Cited

U.S. PATENT DOCUMENTS

2009/0211770 A1* 8/2009 Nutley ..... E21B 33/1208 294/86.26
2011/0098202 A1* 4/2011 James ..... C09K 8/5086 507/221
2015/0034336 A1* 2/2015 Morrison ..... E21B 17/1028 166/381
2018/0347288 A1 12/2018 Fripp et al.
2019/0178063 A1 6/2019 Greci et al.
2020/0072016 A1 3/2020 Al-Gouhi et al.
2020/0325749 A1 10/2020 Fripp et al.
2021/0123310 A1 4/2021 Fripp et al.
2021/0131210 A1 5/2021 Greci et al.
2021/0156220 A1 5/2021 Fripp et al.
2021/0189817 A1 6/2021 Fripp et al.
2021/0207458 A1 7/2021 Besselink et al.
2021/0222509 A1 7/2021 Fripp et al.
2021/0222510 A1 7/2021 Fripp et al.
2021/0270093 A1 9/2021 Fripp et al.
2021/0270103 A1 9/2021 Greci et al.
2021/0332659 A1 10/2021 Fripp et al.
2021/0363852 A1 11/2021 Fripp et al.
2022/0049574 A1 2/2022 Holderman et al.
2022/0112790 A1 4/2022 Cho et al.
2022/0127918 A1 4/2022 Eldho et al.
2022/0178222 A1* 6/2022 Fripp ..... E21B 33/1208

OTHER PUBLICATIONS

Ellison, C.R., Abdelsayed, V., Smith, MW. 2023. Analysis of char structure and composition from microwave and conventional pyrolysis/gasification of low and middle rank coals. Fuel. https://doi.org/10.1016/j.fuel.2023.129301 (Year: 2023).*

Ellison, C., Lauterbach, J. and Smith, M.W., 2024. Activated carbon supported Ni, Fe, and bimetallic NiFe catalysts for COx-free H2 production by microwave methane pyrolysis. International Journal of Hydrogen Energy, 55, pp. 1062-1070. https://doi.org/10.1016/j.ijhydene.2023.11.150 (Year: 2024).*

International Search Report and Written Opinion for International Patent Application No. PCT/US2022/030042 dated Feb. 8, 2023.

* cited by examiner

FAST-ACTING SWELLABLE DOWNHOLE SEAL

BACKGROUND

Wells are routinely drilled to recover hydrocarbons such as oil and gas. It is often necessary to isolate annular flow paths along the length of a wellbore during the life of a well. Packers, for example, can be used to seal an annulus between downhole tubing and the wellbore. Two or more packers can be placed downhole to isolate a zone along the length of the wellbore between the packers. There are various types of packers, which can be grouped according to type or function including mechanical set packers, inflatable packers, and hydraulic packers, among others.

One type of packer referred to generally as a swell packer conventionally uses an elastomeric material that swells in contact with certain fluids. The materials in conventional swell packers may form a seal relatively quickly, but have pressure ratings limited by the relatively soft material. The elastomers may degrade in high-salinity and/or high-temperature environments. The elastomers may also lose resiliency over time resulting in failure and/or necessitating repeated replacement. Replacing swell packers may require halting wellbore operations, resulting in a loss of productive time and the need for additional expenditure to mitigate damage and correct the failed swell packer. Alternatively, there may be a loss of isolation between zones that may result in reduced recovery efficiency or premature water and/or gas breakthrough.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
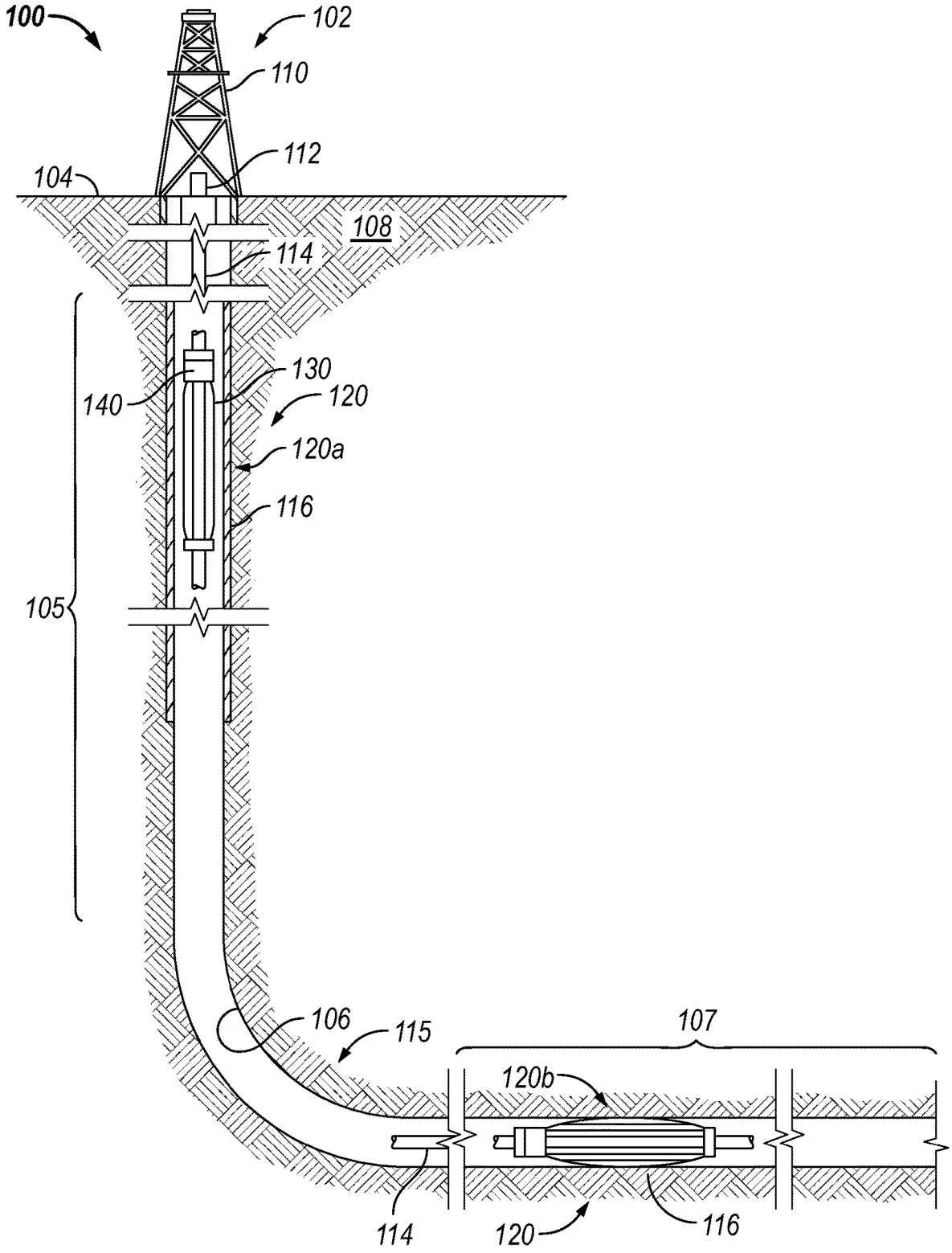
FIG. 1 is an elevation view of a well system in which one or more downhole sealing tools may be deployed.

Downhole sealing devices and methods are disclosed that use a swellable material that swells in response to exposure of an activation fluid. Examples of swellable material include a swellable rubber such as a polymer that expands through absorption/adsorption and a swellable metallic material comprising a metal that expands through a chemical reaction. The disclosure also includes a range of sealing element and actuator configurations that cooperate to accelerate activation of the swellable material. This may enable faster setting times, and may allow even expandable metallic material configurations to rival the setting rates of swellable elastomer packers. An actuator is moveable on a tool mandrel to increase a separation along at least a portion of the expandable wires to increase their exposure to the activation fluid, which may accelerate the activation and swelling and reduce the overall sealing time.

The swellable metallic material, in particular, is capable of forming a more robust and lasting seal than elastomer-based swell packers. The disclosed sealing devices and methods may therefore reduce or avoid some of the problems that plague elastomeric seals, particularly when the swellable metallic material is used. For example, the swellable metallic material is more suitable than elastomers for operation in extreme temperature limits, low temperature sealing limits, and dynamic applications such as swabbing while running. The swellable metallic materials experience less extrusion over time and may better conform to irregular shapes.

A downhole sealing tool according to various examples includes a tool mandrel configured for lowering into a wellbore. For example, the tool mandrel may include a connector for use with a tubing string, coiled tubing, wirelines, or other suitable conveyance for lowering the sealing tool into a well. A swellable metallic sealing element carried on the tool mandrel includes a plurality of expandable metal wires supported along the tool mandrel. The expandable metal wires have a large surface-area-to-mass ratio as compared with a unitary sealing element. The wires may be closely packed on the mandrel in a run-in-hole (RIH) condition, and are separable downhole to increase their exposure to activation fluid when setting. An actuator is configured to increase a separation between the expandable metal wires along at least a portion thereof, such as by bowing the wires outwardly or otherwise spreading them apart, or by agitating and releasing them. The increased separation allows the swellable metallic material to be readily exposed to the activation fluid, thus accelerating the rate of swelling.

The swellable material may comprise a swellable rubber in some examples, and a swellable metallic material in some examples. In either case, the swellable material may be of a composition and/or structure that it swells appreciably and sufficiently to form a seal with a sealing surface (e.g., the inner bore of a casing or other metal tubular) at least in the described structural arrangements disclosed herein. For example, a swellable material may sufficiently expand in response to contact with an activation fluid to seal a wellbore annulus. Examples of a swellable rubber configured to expand in response to exposure to an activation fluid and a swellable metallic material configured to expand in response to exposure to an activation fluid are now provided.

A swellable rubber according to this disclosure may comprise an oil swellable rubber, such as ethylene propylene diene terpolymer (EPDM) rubber. The swellable rubber may comprise a water-swellable rubber with super absorbent additives (SAP) that will swell in water. The swellable rubber may comprise a thermal swelling elastomer that uses thermal expansion from a temperature change in order to change size, such as rubber that has been compounded with paraffin wax, which will expand when the wax melts. The swellable rubber may include reinforcing material, such as fibers longitudinally aligned so as not to interfere with swelling but to provide stiffening.

The swellable rubber may be created from a swelling part and a non-swelling part by an adhesive or by in-mold bonding, or by another similar technique. A sealing element may thus comprise a non-swelling rubber including examples such as Nitrile, hydrogenated nitrile butadiene rubber (HNBR), fluro-elastomers (FKM), perfluoro-elastomers (FFKM), and/or natural rubbers. The swellable rubber may include a swellable rubber bonded to a non-swelling rubber, a water-swelling rubber bonded to an oil-swelling rubber, and/or a water-swelling rubber bonded with a water-contracting rubber.

A swellable metallic material according to this disclosure include a specific class of metallic materials that may comprise metals and metal alloys and may swell by the formation of metal hydroxides. The activation fluid for swellable metallic materials may comprise a brine. The swelling may be caused at least in part by the swellable metallic materials undergoing metal hydration reactions in the presence of brines or other activation fluid to form metal hydroxides.

The sealing element with swellable metallic material may be placed in proximity to a selected flow path and then activated at a desired location along the wellbore by the activation fluid. Activation may cause, induce, or otherwise participate in the reaction that causes the material to expand to seal an annulus of a wellbore. Activation may cause the swellable metallic material to increase its volume, become displaced, solidify, thicken, harden, or a combination thereof. The swellable metallic materials may swell in high-salinity and/or high-temperature environments where elastomeric materials, such as rubber, can perform poorly.

In one or more embodiments, the metal hydroxide occupies more space than the base metal reactant. This expansion in volume allows the swellable metallic material to swell. For example, a mole of magnesium has a molar mass of 24 g/mol and a density of 1.74 g/cm3 which results in a volume of 13.8 cm/mol. Magnesium hydroxide has a molar mass of 60 g/mol and a density of 2.34 g/cm3 which results in a volume of 25.6 cm/mol. 25.6 cm/mol is 85% more volume than 13.8 cm/mol. As another example, a mole of calcium has a molar mass of 40 g/mol and a density of 1.54 g/cm3 which results in a volume of 26.0 cm/mol. Calcium hydroxide has a molar mass of 76 g/mol and a density of 2.21 g/cm3 which results in a volume of 34.4 cm/mol. 34.4 cm/mol is 32% more volume than 26.0 cm/mol. As yet another example, a mole of aluminum has a molar mass of 27 g/mol and a density of 2.7 g/cm3 which results in a volume of 10.0 cm/mol. Aluminum hydroxide has a molar mass of 63 g/mol and a density of 2.42 g/cm3 which results in a volume of 26 cm/mol. 26 cm/mol is 160% more volume than 10 cm/mol. The swellable metallic material comprises any metal or metal alloy that may undergo a hydration reaction to form a metal hydroxide of greater volume than the base metal or metal alloy reactant. The metal may become separate particles during the hydration reaction and these separate particles lock or bond together to form what is considered as a swellable metallic material.

Examples of suitable metals for the swellable metallic material include, but are not limited to, magnesium, calcium, aluminum, tin, zinc, beryllium, barium, manganese, or any combination thereof. Preferred metals include magnesium, calcium, and aluminum. Examples of suitable metal alloys for the swellable metallic material include, but are not limited to, any alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper.

In some examples, the metal alloys may comprise alloyed elements that are not metallic. Examples of these nonmetallic elements include, but are not limited to, graphite, carbon, silicon, boron nitride, and the like. In some examples, the metal is alloyed to increase reactivity and/or to control the formation of oxides.

In some examples, the metal alloy is also alloyed with a dopant metal that promotes corrosion or inhibits passivation and thus increased hydroxide formation. Examples of dopant metals include, but are not limited to nickel, iron, copper, carbon, titanium, gallium, mercury, cobalt, iridium, gold, palladium, or any combination thereof. In examples where the swellable metallic material comprises a metal alloy, the metal alloy may be produced from a solid solution process or a powder metallurgical process. The sealing element comprising the metal alloy may be formed either from the metal alloy production process or through subsequent processing of the metal alloy. As used herein, the term "solid solution" may include an alloy that is formed from a single melt where all of the components in the alloy (e.g., a magnesium alloy) are melted together in a casting. The casting can be subsequently extruded, wrought, hipped, or worked to form the desired shape for the sealing element having the swellable metallic material. Preferably, the alloying components are uniformly distributed throughout the metal alloy, although intragranular inclusions may be present, without departing from the scope of the present disclosure.

It is to be understood that some minor variations in the distribution of the alloying particles can occur, but it is preferred that the distribution is such that a homogenous solid solution of the metal alloy is produced. A solid solution is a solid-state solution of one or more solutes in a solvent. Such a mixture is considered a solution rather than a compound when the crystal structure of the solvent remains unchanged by addition of the solutes, and when the mixture remains in a single homogeneous phase. A powder metallurgy process generally comprises obtaining or producing a fusible alloy matrix in a powdered form. The powdered fusible alloy matrix is then placed in a mold or blended with at least one other type of particle and then placed into a mold. Pressure is applied to the mold to compact the powder particles together, fusing them to form a solid material which may be used as the swellable metallic material.

In some alternative examples, the swellable metallic material comprises an oxide. As an example, calcium oxide reacts with water in an energetic reaction to produce calcium hydroxide. 1 mole of calcium oxide occupies 9.5 cm3 whereas 1 mole of calcium hydroxide occupies 34.4 cm3 which is a 260% volumetric expansion. Examples of metal oxides include oxides of any metals disclosed herein, including, but not limited to, magnesium, calcium, aluminum, iron, nickel, copper, chromium, tin, zinc, lead, beryllium, barium, gallium, indium, bismuth, titanium, manganese, cobalt, or any combination thereof.

A swellable metallic material may be selected that does not degrade into the brine. As such, the use of metals or metal alloys for the swellable metallic material that form relatively water-insoluble hydration products may be preferred. For example, magnesium hydroxide and calcium hydroxide have low solubility in water. In some examples, the metal hydration reaction may comprise an intermediate step where the metal hydroxides are small particles. The small particles have a maximum dimension less than 0.1 inch and generally have a maximum dimension less than 0.01 inches. In some embodiments, the small particles comprise between one and 100 grains (metallurgical grains).

In some alternative examples, the swellable metallic material is dispersed into a binder material. The binder may be degradable or non-degradable. In some examples, the binder may be hydrolytically degradable. The binder may be swellable or non-swellable. If the binder is swellable, the binder may be oil-swellable, water-swellable, or oil- and water-swellable. In some examples, the binder may be porous. In some alternative examples, the binder may not be porous. General examples of the binder include, but are not limited to, rubbers, plastics, and elastomers. Specific examples of the binder may include, but are not limited to, polyvinyl alcohol, polylactic acid, polyurethane, polyglycolic acid, nitrile rubber, isoprene rubber, PTFE, silicone, fluoroelastomers, ethylene-based rubber, and PEEK. In some embodiments, the dispersed swellable metallic material may be cuttings obtained from a machining process.

In some examples, the metal hydroxide formed from the swellable metallic material may be dehydrated under sufficient swelling pressure. For example, if the metal hydroxide resists movement from additional hydroxide formation, elevated pressure may be created which may dehydrate the metal hydroxide. This dehydration may result in the formation of the metal oxide from the swellable metallic material. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water. The dehydration of the hydroxide forms of the swellable metallic material may allow the swellable metallic material to form additional metal hydroxide and continue to swell.

FIG. 1 is an elevation view of a well system 100 in which one or more downhole sealing tools may be deployed downhole. In FIG. 1, a packer 120 is one non-limiting example of such a wellbore sealing device. The well system 100 may include an oil and gas rig 102 arranged at the earth's surface 104. The rig 102 may include a large support structure, such as a derrick 110, erected over the wellbore 106 on a support foundation or platform, such as a rig floor 112. Even though certain drawing features of FIG. 1 depict a land-based oil and gas rig 102, it will be appreciated that the embodiments of the present disclosure are useful with other types of rigs, such as offshore platforms or floating rigs used for subsea wells, and in any other geographical location. For example, in a subsea context, the earth's surface 104 may be the floor of a seabed, and the rig floor 112 may be on the offshore platform or floating rig over the water above the seabed. A subsea wellhead may be installed on the seabed and accessed via a riser from the platform or vessel.

A wellbore 106 may be drilled through the various strata of an earthen formation 108 according to a wellbore plan. The wellbore may comprise a desired wellbore path from where drilling of the wellbore 106 is initiated at the surface 104 (i.e., the "heel") to the end of the well (i.e., the "toe"). The initial portion of the wellbore 106 is typically vertically downward, as the drill string would generally be suspended vertically from the rig 102. Thereafter, the wellbore 106 may deviate in any direction as measured by azimuth or inclination, which may result in sections that are vertical, horizontal, angled up or down, and/or curved. The wellbore path in FIG. 1 is simplified for ease of illustration, and is not to scale. In this example, the wellbore path includes an initial, vertical section 105, followed by at least one deviated section 115, which transitions from the vertical section 105 to a horizontal or lateral section 107. Since the wellbore 106 may deviate, the term uphole generally refers to a direction along the wellbore path toward the surface 104 and the term downhole generally refers to a direction along the wellbore path toward the toe, even in cases where uphole is vertically below downhole at a particular position along the deviated path.

The wellbore 106 may be at least partially cased with a string of casing 116 at selected locations within the wellbore 106, while other portions of the wellbore 106 may remain uncased. In FIG. 1, by way of example, the casing 116 is shown along just a portion of the vertical section 105 and the remainder of the wellbore 106 is shown as open hole. The casing 116 may be secured within the wellbore 106 using cement. In other configurations, the casing 116 may be omitted entirely.

A hoisting apparatus (not shown) may be suspended from the rig 102 for raising and lowering equipment in the wellbore 106 on a conveyance 114. The conveyance 114 may be a tubular conveyance also used to convey fluids, and to support electrical communication, power, and fluid transmission during wellbore operations. The conveyance 114 may include any suitable equipment for mechanically conveying tools. Such conveyance may include, for example, a tubular string made up of interconnected tubing segments, coiled tubing, or any combination of the foregoing. In some examples, conveyance 114 may provide mechanical suspension, as well as electrical and fluidic connectivity, for downhole tools. The conveyance 114 may be used to lower one or more tools into the wellbore 106, i.e. run/tripped into the hole. When a wellbore operation is complete, or when it becomes necessary to exchange or replace tools or components of the conveyance 114, the conveyance 114 may be raised or fully removed from the wellbore 106, i.e., tripped out of the hole.

The packer 120 is one example of a downhole sealing tool and is drawn in a simplified in manner in FIG. 1 for discussion purposes. The packer 120 is shown in a first example location **120*a* in a run-in condition as it is being lowered into a wellbore 106, i.e., run in hole (RIH), and a second location 120*b* downhole of the first location 120*b* where the packer 120 may be set or in the process of being set into sealing engagement with the wellbore 106. The packer 120 includes a sealing element 130 for deploying into sealing engagement with the wellbore 106 (e.g., with the casing 116 or an open-hole portion of the wellbore 106. The packer 120 may be lowered into the wellbore 106 in the RIH condition, such as shown at the first location 120*b*, and then deployed at a selected location within the wellbore 106, such as adjacent to a zone to be sealingly isolated. The sealing element 130 has a plurality of expandable metal members (discussed below) formed with a swellable metallic material that swells in response to exposure to an activation fluid. The activation fluid may be provided from any location, such as flowed downhole from the surface 104 or released from some location along the work string, for example. The packer 120 also includes an actuator 140 moveable on the tool mandrel to increase a separation along at least a portion of the expandable metal wires. The sealing element 130 may be alternately referred to as the "element" of the packer 120**.

Any number of packers configured according to this disclosure may be run in hole on a work string to be deployed to different locations along the wellbore 106. For example, multiple packers 120 may be used to isolate zones of the annulus between wellbore 106 and a tubing string by providing a seal between production tubing and casing 116 or between production tubing and open hole. In examples, a packer may be disposed on production tubing.

Figure 2:
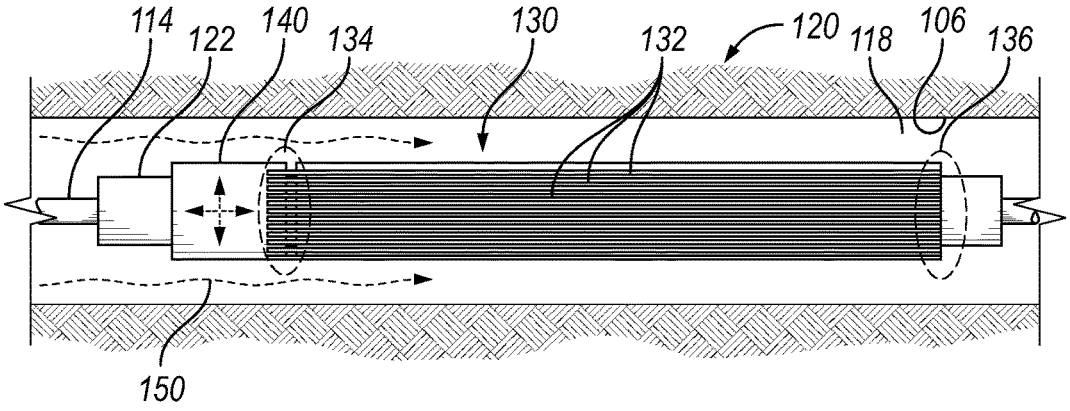
FIG. 2 is a schematic, side view of the packer of FIG. 1, in a run-in-hole condition.

FIG. 2 is a schematic, side view of a wellbore sealing device, e.g., the packer 120 of FIG. 1, in a run-in-hole (RIH) condition. The packer 120 includes a tool mandrel 122 configured for lowering into the wellbore 106 on the conveyance 114. For example, a tubing string, coiled tubing, wireline, or other suitable conveyance may include any suitable connection for releasably coupling the packer 120 to the conveyance 114 via the tool mandrel 122. The tool mandrel 122 may also support a plurality of packer components thereon, including a sealing element 130 and an actuator 140 used when deploying the sealing element 130.

The sealing element 130 includes a plurality of elongate structures ("expandable metal wires") 132 supported along the tool mandrel 122. These expandable metal wires 132 are described as "wires" given their generally elongate form factor. In at least some configurations, the elongate form factor includes a length to diameter ratio of greater than 5. In at least some configurations, a wire may have an outer diameter less than one quarter of an inch (6.4 mm). The term wire is not intended to limit to any particular cross-sectional shape, and could include an elongate structure of any cross-section including but not limited to round, square, or U-shaped. These elongated structures are more specifically described as "expandable" in that they comprise a swellable material that swells in response to exposure to an activation fluid 150. These elongate structures are even more specifically referred to as the expandable "metal" wires 132 in this example and any other configurations wherein the wires comprise a swellable metallic material configured to swell in response to exposure to an activation fluid 150.

The activation fluid 150 may be discretionally supplied when it is desired to activate the swellable metallic material in the process of setting the packer 120. The swelling of the wires, at least in part, will allow the sealing element 130 to seal off an annulus 118 between the tool mandrel 122 and the wellbore 106. The use of many expandable metal wires rather than a unitary structure (e.g., a continuous sleeve) increases the surface area of the swellable metallic material relative to what the surface area would be of the unitary structure having the same mass as the combined mass of the expandable metal wires 132. By increasing the surface area, the reaction of the activation fluid with the expandable metal wires 132 may be initiated more quickly and/or proceed more quickly than a unitary structure.

The actuator 140 is moveably supported on the tool mandrel to facilitate deployment of the sealing element 130. The expandable metal wires 132 of the sealing element 130 are initially closely packed on the tool mandrel 122 to minimize a RIH diameter. In the RIH condition, the expandable metal wires 132 may be packed tightly enough that fluid does not readily flow between them. The actuator 140 is positioned adjacent to a first end 134 of the expandable metal wires 132, and may be coupled to, abutting with, and/or moveable into engagement with the first end 134 of the expandable metal wires 132. For when it is desired to set the packer 120 and activate the swellable metallic material, the actuator is moveable on the tool mandrel to increase the separation between the expandable metal wires 132 along at least a portion of the expandable metal wires 132.

The actuator 140 may be used to increase the separation between the expandable metal wires 132 in any of a variety of ways depending on the configuration, of which examples are provided in subsequent figures. The actuator 140 (or a portion thereof) is moveable with respect to the tool mandrel 122 axially, rotationally, or a combination thereof, as generally indicated by example arrows. The actuator may comprise a collar moveable from a first position to a second position, where the first and second positions are spaced axially, circumferentially, or a combination thereof. In one or more examples, the actuator 140 or a portion thereof (e.g., a collar) may be urged toward the expandable metal wires 132, i.e., in a direction from the first end 134 toward a second end 136 of the expandable metal wires. In one or more examples, the actuator 140 or a portion thereof may be rotated in a direction that at least partially unwinds expandable metal wires that were initially circumferentially wound (e.g., in a helix) around the tool mandrel 122. These examples of movement may cause the expandable metal wires 132 to bow radially outwardly to increase the separation along at least a portion thereof. The elongate form factor and relatively narrow cross-sectional dimensions of the expandable metal wires 132 are preferably selected to give the expandable metal wires some flexibility when it is desired to increase separation to facilitate flow of the activation fluid therebetween. However, in one or more configurations the wires may be rigid, like rods, that can be radially translated rather than flexed. In one or more examples, the actuator 140 may even move away from expandable metal wires 132 in a manner that agitates the expandable metal wires 132 to increase separation therebetween.

Figure 3A:
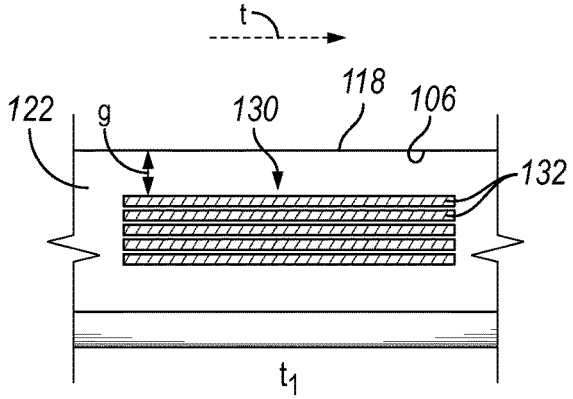
FIG. 3A schematically depicts the sealing element at time t1, when the expandable metal wires are still in a closely-packed RIH configuration.
Figure 3B:
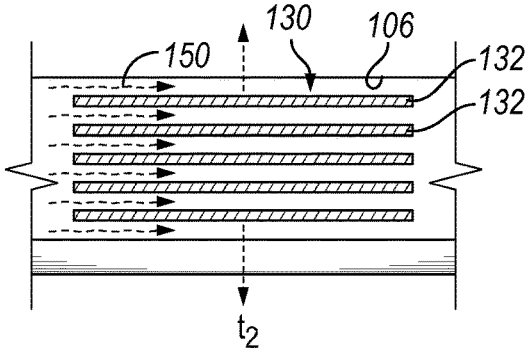
FIG. 3B schematically depicts the sealing element at time t2, with the expandable metal wires separated and an activation fluid being delivered to the sealing element.
Figure 3C:
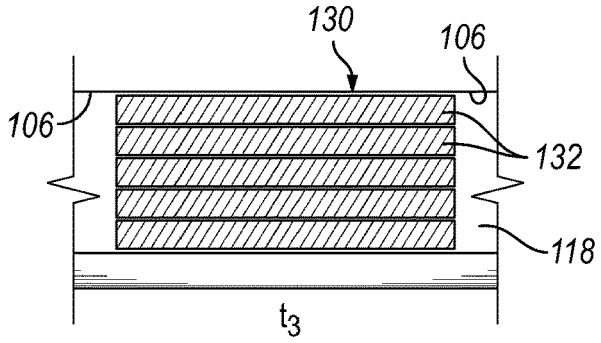
FIG. 3C schematically depicts the sealing element at time t3, after the swellable metallic material has been activated and the expandable metal wires are expanding.

FIGS. 3A-3C are a schematic sequence of deployment of the sealing element 130 of FIG. 2 at three instants in time "t1," "t2," "t3." The sequence graphically focuses on a portion of an annulus 118 between the tool mandrel 122 and the wellbore 106.

FIG. 3A schematically depicts the sealing element 130 at time t1, when the expandable metal wires 132 are still in a closely-packed RIH configuration, such as they would be when the packer is run in hole. The activation fluid has not yet been applied to the expandable metal wires 132 and so no appreciable activation of the swellable metallic material has occurred. A significant annular gap "g" is present between the sealing element 130 and the wellbore 106 in the RIH condition to allow the packer to be lowered into the wellbore 106. The optionally tight packing of the expandable metal wires 132 may also desirably minimize any incidental exposure of surface area of swellable metallic material to well fluids that might react therewith prior to an intentional activation of the sealing element 130.

FIG. 3B schematically depicts the sealing element 130 at time t2, with the expandable metal wires 132 separated and an activation fluid 150 being delivered to the sealing element 130. The expandable metal wires 132 may have been separated using an actuator, for example, to allow the exposure of the activation fluid 150 around and/or between the individual expandable metal wires 132. This separation between the expandable metal wires 132 may occur prior to, concurrent with, or at some time after onset of delivery of the activation fluid 150 to the sealing element 130. Preferably, the separation of the expandable metal wires 132 and the delivery of activation fluid 150 would occur close in time so that the activation fluid 150 can get between the expandable metal wires 132 and is readily exposed to the combined surface area of the expandable metal wires 132.

FIG. 3C schematically depicts the sealing element 130 at time t3, after the activation of the swellable metallic material has begun. As part of that reaction, swelling of the expandable metal wires 132 occurs, which causes the expandable metal wires 132 to expand. Expansion of the expandable metal wires 132 closes spaces between the previously separated expandable metal wires 132 and between the group of expandable metal wires 132 and the wellbore 106. Over time, as the reaction proceeds, substantially all of the annulus 118 that was initially present at time t1 is filled by swelled metallic material of the expandable metal wires 132. The expandable metal wires 132 may coalesce into a collective mass of swelled metallic material.

Figure 4:
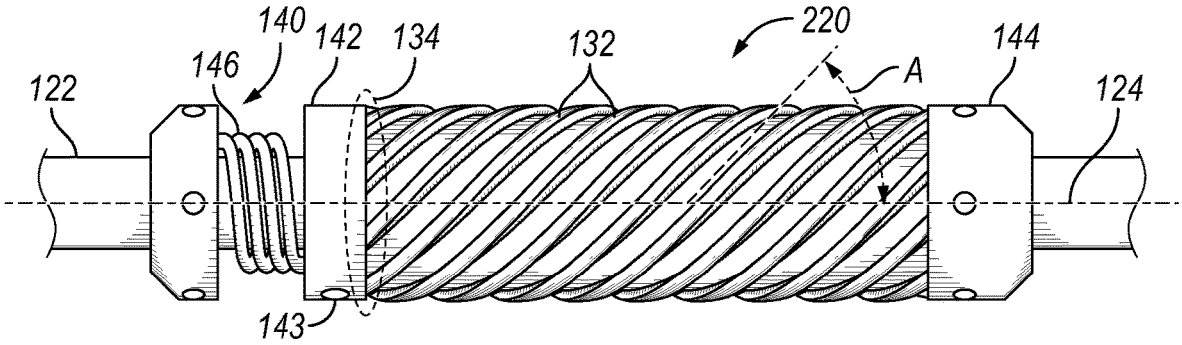
FIG. 4 is a side view of a sealing device according to an example configuration wherein the expandable metal wires are initially wound about the tool mandrel.

FIG. 4 is a side view of a sealing device (e.g., packer) 220 according to an example configuration wherein the expandable metal wires 132 are initially wound about the tool mandrel 122 between a first collar 142 and a second collar 144, such as in a helical fashion. The expandable metal wires 132 may generally define a helical shape, at some acute angle "A" with a mandrel axis 124. By way of example, the angle A is illustrated at about forty-five degrees in FIG. 4, but other acute angles (i.e., greater than zero and less than ninety degrees) may be acceptable. The first collar 142 is a moveable collar, which may be considered a component of the actuator 140. The first collar 142 is moveable at least rotationally with respect to the tool mandrel 122 and with respect to the second collar 144. The expandable metal wires 132 may be coupled at the first end 134 to the first collar 142. A biasing member 146, such as a torsion spring, is included with the actuator 140 to bias the first collar 142 rotationally toward the second position. However, the first collar 142 is initially retained by a retention member 143 in the position shown (the first position in this example) so that the expandable metal wires 132 remain tightly wound until it is desired to set the sealing device 220.

The retention member 143 may include one or more pins releasable at a selected sealing location in a well. The pins may be released by shearing, which requires an application of a force downhole, or by dissolving, which may be accomplished by disposing a suitable solvent downhole. A dissolvable pin or other dissolvable member may comprise a dissolvable material with sufficient mechanical properties to initially retain a component, but which may be dissolvable in a commercial viable amount of time to release that component. The dissolvable material may dissolve in a suitable solvent, for example, or by galvanic corrosion, in non-limiting examples.

The second collar 144 may be a fixed collar that is fixed (e.g., axially and rotationally) to the tool mandrel 122, so that the second collar 144 remains stationary as the first collar 142 is moved with respect to the second collar 144. In another configuration, the second collar 144 may alternatively be moveable, but in a different direction (e.g., an opposite direction) than the first collar 142. In either case, relative movement between the first and second collars 142, 144 imparts a desired separation between the expandable metal wires 132.

Figure 5:
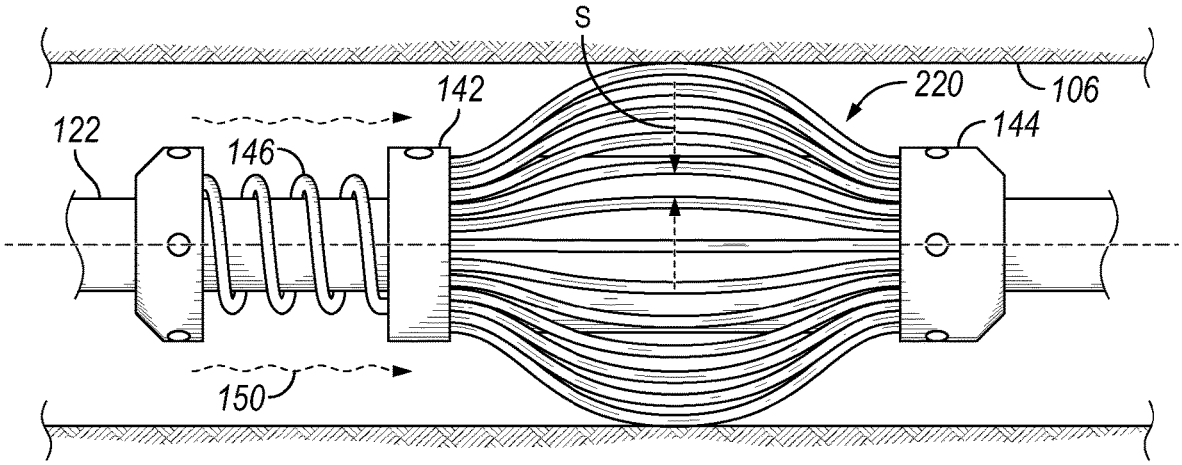
FIG. 5 is a side view of the sealing device of FIG. 4 after the first collar has been released and moved rotationally to a second position rotationally spaced from its first position of FIG. 4.

FIG. 5 is a side view of the sealing device 220 of FIG. 4 after the first collar 142 has been released and moved rotationally to a second position rotationally spaced from its first position of FIG. 4. In particular, the pin(s) or other retention member 143 have been dissolved or otherwise released, so that the torsion spring or other biasing member 146 urges the first collar 142 rotationally with respect to the second collar 144. As a result of this relative movement of the first collar 142 with respect to the second collar 144, the expandable metal wires 132 have been at least partially unwound from the tool mandrel 122, causing the expandable metal wires 132 to bow radially outwardly toward the wellbore 106. This outward bowing increases a separation "S" between the expandable metal wires 132 along at least a portion thereof. The increased separation allows an activation fluid 150 to freely flow between the expandable metal wires 132 when it is desired to activate the swellable metallic material of the expandable metal wires 132.

Figure 6:
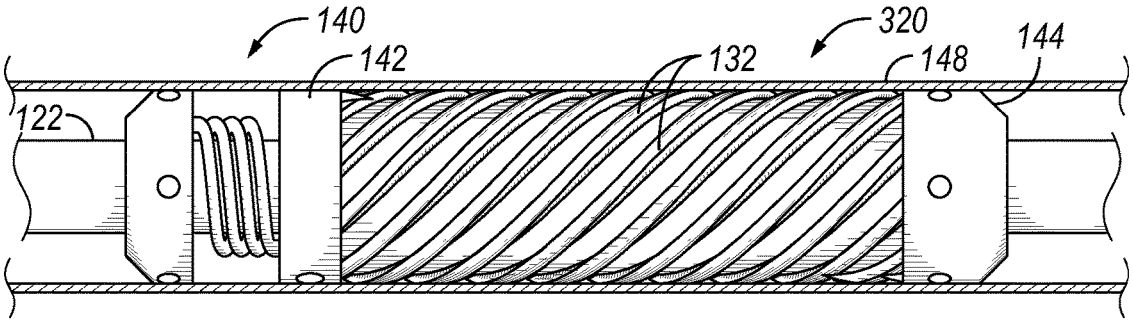
FIG. 6 is a side view of an alternate configuration of a packer that uses a dissolvable shroud to initially constrain the expandable metal wires.

FIG. 6 is a side view of an alternate configuration of a packer 320 that uses a dissolvable shroud 148 to initially constrain the expandable metal wires 132 to prevent or limit separation therebetween. The packer 320 may be similar in some respect to the packer 220 of FIG. 4, including helically wound expandable metal wires 132 and the first collar 142 moveable with respect to the second collar 144. As in the configuration of FIG. 4, the expandable metal wires 132 may be initially wound about the tool mandrel 122 by rotating the first collar 142 with respect to the second collar 144. Then, the dissolvable shroud 148 may be positioned around the expandable metal wires 132, and optionally around a portion of the actuator 140 and second collar 144. The dissolvable shroud 148 may have a close fit, and optionally a compression fit, around these components, such as to keep the expandable metal wires 132 in close engagement with each other and with the tool mandrel 122 when in the RIH condition. The shroud 148 may additionally serve as a protective cover for these components while running into hole and otherwise prior to setting the packer 320. The shroud 148 may be formed of a dissolvable material that dissolves in a fluid, whether it be the same fluid as the activation fluid and/or another fluid. Once the shroud 148 dissolves, the expandable metal wires 132 will be free to bow radially outwardly, as urged by movement of the collar 142 in response to the biasing action of the torsion spring or other biasing member 146.

Figure 7:
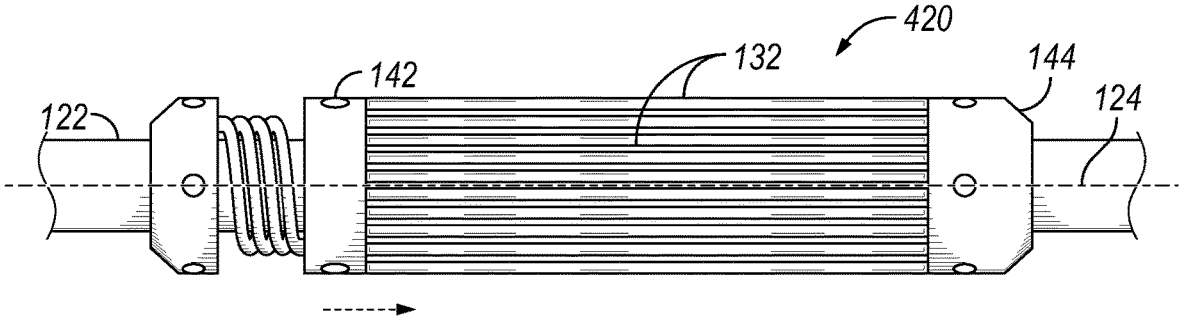
FIG. 7 is a side view of another example configuration of a packer that uses axial movement of the first collar to urge the expandable metal wires radially outwardly.

FIG. 7 is a side view of another example configuration of a packer 420 that uses axial movement of the first collar 142 to urge the expandable metal wires 132 radially outwardly. The expandable metal wires 132 are initially arranged along the tool mandrel 122 in a closely-packed arrangement between the first collar 142 and the second collar 144. The expandable metal wires 132 are aligned (parallel) with the tool mandrel axis 124 in this configuration, although the packer 420 would still work if the expandable metal wires 132 were alternatively wrapped around the tool mandrel 122 like in FIG. 4. The first collar 142 is again a moveable collar, which may be considered a component of the actuator 140. However, the first collar 142 is now moveable at least axially with respect to the tool mandrel 122 and with respect to the second collar 144. The expandable metal wires 132 may be coupled at the first end 134 to the first collar 142, or the first collar 142 may otherwise abut the first end 134 of the expandable metal wires 132. The first collar 142 is initially retained by a retention member 143 in the position of FIG. 7 (the first position in this example) so that the expandable metal wires 132 remain closely arranged about the tool mandrel 122 until it is desired to set the packer 420. The retention member 143 may include one or more pins, which may be dissolvable or otherwise releasable at a selected sealing location in a well. Alternatively, a shroud may be used to retain the expandable metal wires 132 such as in FIG. 6.

Figure 8:
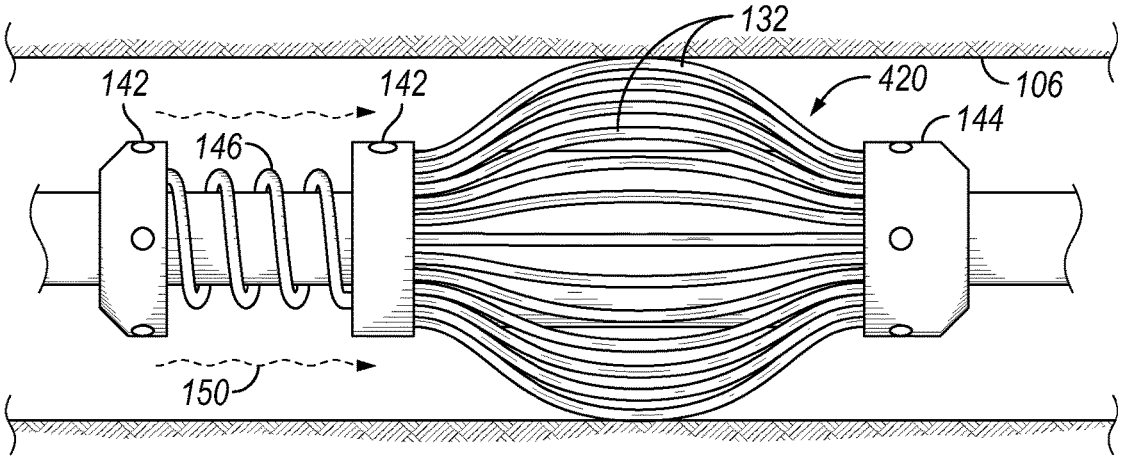
FIG. 8 is a side view of the packer of FIG. 7 with the first collar moved axially toward the second collar, causing the expandable metal wires to bow outwardly.

FIG. 8 is a side view of the packer 420 of FIG. 7 with the first collar 142 moved axially toward the second collar 144 to a second position, causing the expandable metal wires to bow outwardly toward the wellbore 106. For the first collar 142 to be moved, the retention member is first dissolved or otherwise releases the first collar 142. The biasing member 146 in this embodiment may comprise a compression spring to bias the first collar 142 axially toward the second collar 144. Once the retention member has been dissolved or otherwise releases the first collar 142, the biasing member 146 moves the first collar 142 to the second position. The second collar 144 may be a fixed collar that is fixed (e.g., axially and rotationally) to the tool mandrel 122, so that the second collar 144 remains stationary as the first collar 142 is moved toward the second collar 144. In another configuration, the second collar 144 may alternatively be moveable, but in a different direction, e.g., axially toward the first collar 142. Movement of the first collar 142 toward the second collar 144 urges the expandable metal wires 132 apart, thereby also separating at least a portion of the expandable metal wires 132 so that activation fluid 150 may be exposed to the surface area of the expandable metal wires 132.

Figure 9:
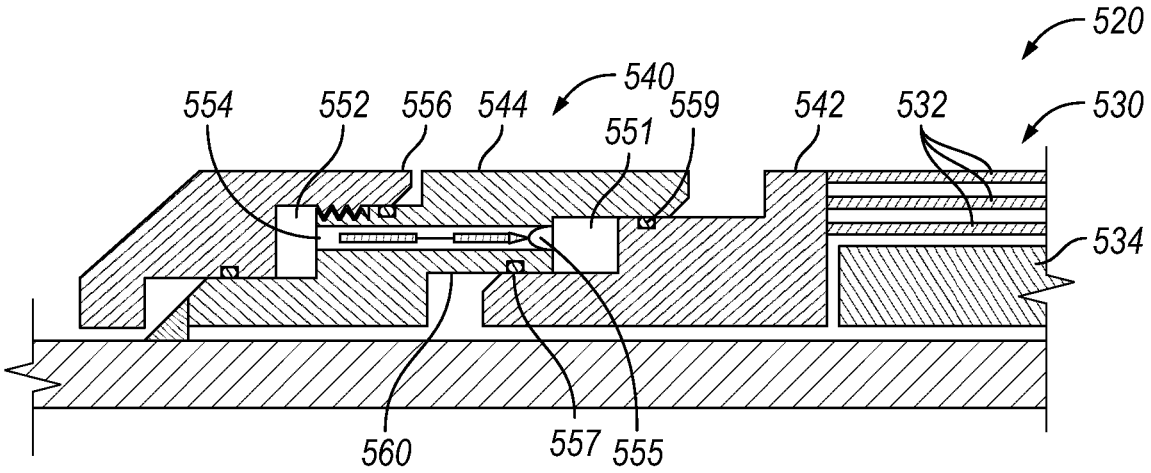
FIG. 9 is a cross-sectional side view of a downhole sealing device with alternative sealing element and actuator configurations.

FIG. 9 is a cross-sectional side view of a downhole sealing device (e.g., packer) 520, with alternative sealing element 530 and actuator 540 configurations. The sealing element 530 includes an assortment of different expandable metal members comprising swellable metallic material. The expandable metal members include expandable metal wires 532 coupled at one end to a collar 542 of the actuator 540. For example, the expandable metal wires 532 may have a shape and form factor allowing them to flex outwardly in response to movement of the collar to increase a spacing therebetween when setting. The expandable metal members also include an expandable metal block 534 that is not coupled to the collar 541. The expandable metal block 534 is not appreciably flexible like the expandable metal wires 532 may be, but has a lower surface-area-to-mass ratio (i.e., a greater mass-to-surface-area ratio) than the expandable metal wires 532. Therefore, the expandable metal wires 532 are expected to react more quickly when exposed to an activation fluid than the expandable metal block 534. Conversely, the expandable metal block 534 may continue to react and swell over a longer period of time than the expandable metal wires 532.

The combination of features described cooperate to provide a "fast-acting" seal, with a quick initial setting via the expandable metal wires 532, but with a longer seal life via the expandable metal block 534, which may continue to react over a longer period of time to reinforce and prolong seal integrity. The expandable metal block 534 may also contain unreacted swellable metallic material at an internal depth from a surface of the expandable metal block 534 not initially exposed to activation fluid. If the expandable metal block 534 becomes damaged such as due to stress, strain, or impact, such damage may beneficially expose additional, previously unreacted swellable metallic material to effectively "heal" such damage.

The actuator 540 is configured to increase separation between the expandable metal wires by agitating and releasing them. The actuator 540 includes an actuator body 544, to which the collar 542 is moveably coupled. A first fluid chamber 551 is defined between the actuator body 544 and the collar 542. The actuator body 544 optionally includes an end cap 556 connectable to the rest of the actuator body 544, such as via a threaded connection, that may facilitate assembly of the actuator 540. A second fluid chamber 552 is spaced from the first fluid chamber 551 and may be at least partially defined by the actuator body 544, which in this example is defined by the end cap 556 and the rest of the actuator body 544. The actuator body 544 defines a flow path 554 between the first fluid chamber 551 and the second fluid chamber 552. A membrane 555 initially blocks the flow path 554 and is capable of holding a pressure imbalance between the first and second fluid chambers 551, 552. The pressure imbalance is used to drive the actuator 540. In particular, the flow path 554 may be unblocked by severing the membrane 555 to equalize pressure along the flow path 554, to move the collar 542 with respect to the actuator body 544. Thus, the membrane 555 may be severed to set the packer at a selected depth within the well.

The pressure imbalance between the first fluid chamber 551 and the second fluid chamber 552 may be generated by configuring the actuator 540 with an atmospheric trap. For example, the first fluid chamber 551 may be exposed to an external pressure while the second fluid chamber 552 may be sealed from the external pressure. The volume of the second fluid chamber 552 may be fixed (in this case, by a fixed position of the end cap 556). The volume of the first fluid chamber 551 is variable by sliding of the collar 542 with respect to the actuator body 544. Sealing members (e.g., o-rings) 557, 559 seal between these moving parts. Thus, as the packer 520 is lowered into the well, a pressure differential between the first and second fluid chambers 551, 552 increases in relation to depth, in this case, with the first fluid chamber 551 being at a lower pressure (i.e. vacuum) and the second fluid chamber 552 filling with fluid and increasing in volume. The membrane 555 is then severed when setting the packer 520 at the desired depth.

The membrane 555 may be severed to unblock the flow path 554 in any of a variety of ways. In one example, an electronically controllable firing pin 560 may be used to sever the membrane 555 downhole at the selected depth. Alternatively, or in addition, the membrane 555 may be configured as a burst disc that is severed by rupturing at a threshold pressure differential corresponding to the desired well depth at which to activate the packer 520.

The pressure differential can be used by the actuator 540 to drive the collar 542 in a selected direction depending on the particular configuration, such as axially toward or away from the sealing element, rotationally, or a combination thereof. The actuator 540 of FIG. 9 is configured to drive the collar 542 away from the expandable metal wires 532 (although alternate embodiments could be constructed as in preceding embodiments whereby the actuator 540 drives the collar 542 toward the expandable metal wires 532). The collar 542, in pulling away, is forcibly separated from the expandable metal wires 532 in this embodiment, which increases separation by agitating and releasing the expandable metal wires 532. The sudden bursting of the membrane 555 and equalization of pressure may cause a rapid separation between the collar 542 and the expandable metal wires 532, to enhance the agitation and separation.

Figure 10:
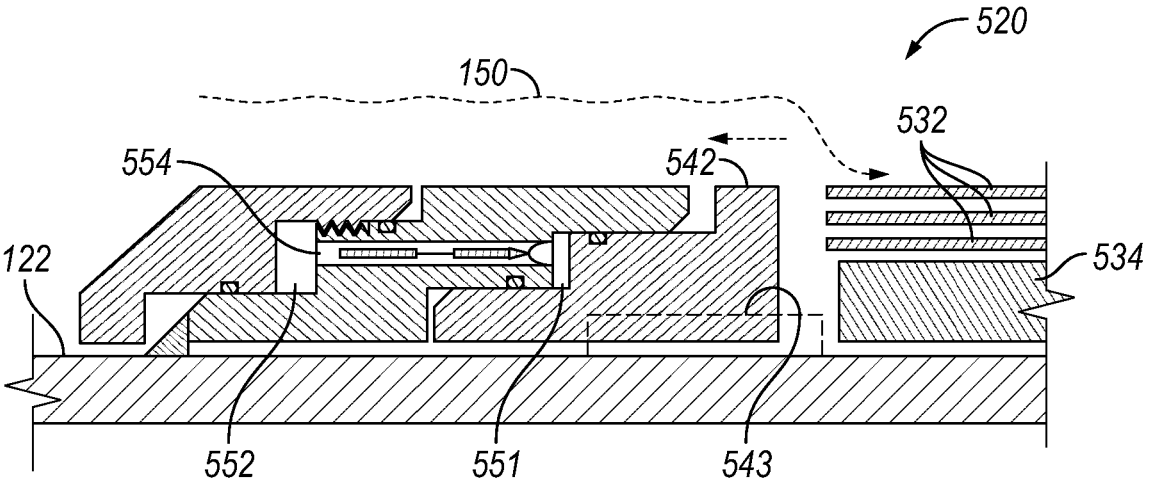
FIG. 10 is a cross-sectional side view of the packer of FIG. 9 after the collar has been separated from the expandable metal wires by equalization of pressure between the first and second fluid chambers.

FIG. 10 is a cross-sectional side view of the packer 520 of FIG. 9 after the pressure has been equalized between the first and second fluid chambers 551, 552. The relatively lower pressure of the second fluid chamber 552 has drawn in fluid from the first fluid chamber 551 through the flow path 554, which drives the movement of the collar 542. The collar 542 has thereby been forcibly urged away from the expandable metal wires 532 to agitate and cause separation between them for exposure to the activation fluid.

In an optional feature, the collar 542 may ride on a track 543 for guiding movement of the collar 542 in a particular path intended to help agitate and separate the expandable metal wires. Such a track 543 may be defined on the tool mandrel 122 to guide the collar 542 rotationally and/or axially with respect to the tool mandrel 122. An activation fluid 150 may again be supplied to the sealing element 530 to initiate expansive reaction of the swellable metallic material of the expandable metal wires 532 and expandable metal block 534. The separation between the expandable metal wires 532 facilitates distribution of the activation fluid therebetween, for faster initial reaction times. The continued exposure of activation fluid 150 to the expandable metal block 534 may prolong the reaction over time to extend the life of the seal formed.

Aspects of this disclosure include methods of sealing a wellbore, which may performed non-exclusively with any of the disclosed apparatus or other apparatus following the disclosed principles. An example method include moving (e.g., lowering) a tool mandrel to a selected position in a wellbore with a plurality of expandable metal wires supported along the tool mandrel. The expandable metal wires comprise a swellable metallic material. The expandable metal wires may be tightly packed initially. When it is desired to seal the wellbore, an actuator may be used to increase a separation along at least a portion of the expandable metal wires. The expandable metal wires may be exposed to an activation fluid, causing the swellable metallic material of the expandable metal wires to swell.

In some examples, the step of increasing the separation along at least the portion of the expandable metal wires comprises moving a collar along the tool mandrel to urge the expandable metal wires radially outwardly. In some examples, the expandable metal wires are initially circumferentially wound around the tool mandrel, and the collar is rotatable to at least partially unwind the expandable metal wires. In other examples, the collar is moved axially along the tool mandrel to urge one end of the expandable metal wires toward an opposing end of the expandable metal wires. In other examples, a combination of axial and rotational movement may be employed. The method may involve a step of biasing the collar to the second position and releasing the collar at a desired depth in the wellbore such that the biasing moves the collar to the second position. A dissolvable member such as a pin or shroud may be used to initially retain the collar in the first position such as to maintain close engagement between the expandable metal wires.

Accordingly, the disclosed apparatus and methods for sealing a wellbore may quickly form a seal using a swellable metallic material. The various embodiments may include any of the various features disclosed herein, including one or more of the following statements.

Statement 1. A downhole sealing tool, comprising: a tool mandrel for lowering into a wellbore; a sealing element including a plurality of expandable wires supported along the tool mandrel, the expandable wires comprising a swellable material that swells in response to exposure to an activation fluid; and an actuator moveable on the tool mandrel to increase a separation along at least a portion of the expandable wires.

Statement 2. The downhole sealing device of Statement 1, wherein the actuator comprises a collar, with the expandable wires coupled at one end to the collar, wherein the collar is moveable from a first position to a second position to urge the expandable wires radially outwardly.

Statement 3. The downhole sealing device of Statement 2, wherein the expandable wires are initially circumferentially wound around the tool mandrel and wherein the collar is rotatable from the first position to the second position to at least partially unwind the expandable wires to urge the expandable wires radially outwardly.

Statement 4. The downhole sealing device of Statement 2 or 3, wherein the collar is axially moveable from the first position to the second position to urge the expandable wires radially outwardly.

Statement 5. The downhole sealing device of any of Statements 2 to 4, wherein the actuator further comprises: a biasing member configured for biasing the collar toward the second position; and a retention member initially securing the collar in the first position and releasable at a selected location in a well for the biasing member to move the collar to the second position.

Statement 6. The downhole sealing device of Statement 5, wherein the retention member comprises a dissolvable pin, a dissolvable shroud about the expandable metal wires, or both.

Statement 7. The downhole sealing device of any of Statements 1 to 6, wherein the expandable wires are expandable metal wires to constrain the expandable wires comprising a swellable metallic material that swell in response to exposure to the activation fluid.

Statement 8. The downhole sealing device of any of Statements 2 to 7, wherein the collar increases the separation by agitating and releasing the expandable wires in moving from the first position to the second position.

Statement 9. The downhole sealing device of any of Statements 1 to 8, wherein the actuator further comprises: a collar, with the expandable wires coupled at one end to the collar; an actuator body defining a first fluid chamber between the actuator body and the collar, a second fluid chamber, and a flow path between the first and second fluid chambers; and a membrane initially blocking the flow path to hold a pressure imbalance between the first and second fluid chambers, wherein the membrane is severable at a selected depth in a well to equalize pressure along the flow path to move the collar with respect to the actuator body.

Statement 10. The downhole sealing device of Statement 9, further comprising: an electronically controllable firing pin disposed in the flow path configured for severing the membrane.

Statement 11. The downhole sealing device of Statement 9 or 10, further comprising a track for guiding movement of the collar rotationally with respect to the tool mandrel as the collar moves axially toward or away from the actuator body.

Statement 12. A method of sealing a wellbore, comprising: moving a tool mandrel to a selected position in the wellbore with a plurality of expandable wires supported along the tool mandrel, the wires comprising a swellable material; increasing a separation along at least a portion of the expandable wires; and with the separation increased, exposing the expandable wires to an activation fluid causing the swellable material of the expandable wires to swell.

Statement 13. The method of Statement 12, wherein increasing the separation along at least the portion of the expandable wires comprises moving a collar along the tool mandrel from a first position to a second position to urge the expandable wires radially outwardly.

Statement 14. The method of Statement 13, wherein the expandable wires are initially circumferentially wound around the tool mandrel and moving the collar along the tool mandrel comprises rotating the collar to at least partially unwind the expandable wires.

Statement 15. The method of Statement 13 or 14, wherein moving the collar along the tool mandrel comprises axially moving the collar to urge one end of the expandable wires toward an opposing end of the expandable wires.

Statement 16. The method of any of Statements 13 to 15, further comprising: biasing the collar to the second position while initially retaining the collar in the first position; and releasing the collar in response to the collar reaching the selected position in the wellbore such that the biasing moves the collar to the second position.

Statement 17. The method of Statement 16, further comprising: using a dissolvable member to initially retain the collar in the first position; and releasing the collar comprises dissolving the dissolvable member.

Statement 18. The method of Statement 16 or 17, further comprising: initially constraining the expandable wires with a dissolvable shroud about the expandable wires; and releasing the collar comprises dissolving the dissolvable shroud.

Statement 19. The method of any of Statements 12 to 18, further comprising: moveably coupling a collar to the expandable wires; initially blocking a flow path between a first and second fluid chamber to hold a pressure imbalance between the first and second fluid chamber; unblocking the flow path when the tool mandrel is at the selected position in the wellbore to equalize pressure along the flow path to move the collar along the tool mandrel.

Statement 20. The method of Statement 19, wherein the first fluid chamber is exposed to an external pressure and the second fluid chamber comprises an atmospheric trap that is sealed from the external pressure such that a pressure differential between the first and second fluid chambers increases as the tool mandrel is lowered into the wellbore.

To facilitate a better understanding of the present invention, the following examples of certain aspects of some embodiments are given. In no way should the following examples be read to limit, or define, the entire scope of the disclosure.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole sealing tool, comprising:

a tool mandrel for lowering into a wellbore;

a sealing element including a plurality of expandable metal wires supported along the tool mandrel, the expandable metal wires swells in response to exposure to an activation fluid, wherein each of the expandable metal wires are initially wound about the tool mandrel between a first collar and a second collar and the expandable metal wires have a length to diameter ratio of greater than 5 and the diameter is less than one quarter of an inch (6.4 mm) in a run-in-hole condition; and an actuator moveable on the tool mandrel to increase a separation along at least a portion of the expandable metal wires.

2. The downhole sealing device of claim 1, wherein the actuator comprises the first collar, with the expandable metal wires coupled at one end to the first collar, wherein the first collar is moveable from a first position to a second position to urge the expandable metal wires radially outwardly.

3. The downhole sealing device of claim 2, wherein the expandable metal wires are initially circumferentially wound around the tool mandrel and wherein the first collar is rotatable from the first position to the second position to at least partially unwind the expandable wires to urge the expandable wires radially outwardly.

4. The downhole sealing device of claim 2, wherein the first collar is axially moveable from the first position to the second position to urge the expandable metal wires radially outwardly.

5. The downhole sealing device of claim 2, wherein the actuator further comprises:

a biasing member for biasing the first collar toward the second position; and a retention member initially securing the first collar in the first position and releasable at a selected location in a well for the biasing member to move the first collar to the second position.

6. The downhole sealing device of claim 5, wherein the retention member comprises a dissolvable pin, a dissolvable shroud about the expandable metal wires, or both.

7. A method of sealing a wellbore, comprising:

moving a tool mandrel to a selected position in the wellbore with a plurality of expandable metal wires supported along the tool mandrel;

increasing a separation along at least a portion of the expandable metal wires by movement of an actuator on the tool mandrel; and with the separation increased, exposing the expandable wires to an activation fluid causing the swellable material of the expandable wires to swell, wherein each of the expandable metal wires are initially wound about the tool mandrel between a first collar and a second collar and the expandable metal wires have a length to diameter ratio of greater than 5 and the diameter is less than one quarter of an inch (6.4 mm) in a run-in-hole condition.

* * * * *